US008169397B2

(12) United States Patent
Park

(10) Patent No.: US 8,169,397 B2
(45) Date of Patent: May 1, 2012

(54) LIQUID CRYSTAL DISPLAY DEVICE AND DRIVING METHOD THEREOF

(75) Inventor: Chang Keun Park, Daegu (KR)

(73) Assignee: LG Display Co., Ltd., Seoul (KR)

( * ) Notice: Subject to any disclaimer, the term of this patent is extended or adjusted under 35 U.S.C. 154(b) by 1185 days.

(21) Appl. No.: 11/987,571

(22) Filed: Nov. 30, 2007

(65) Prior Publication Data

US 2008/0192072 A1 Aug. 14, 2008

(30) Foreign Application Priority Data

Feb. 8, 2007 (KR) ..... 10-2007-0013378

(51) Int. Cl.
*G09G 3/36* (2006.01)

(52) U.S. Cl. ..... 345/101; 345/690

(58) Field of Classification Search ..... 345/101, 345/204, 690; 349/72, 199
See application file for complete search history.

(56) References Cited

U.S. PATENT DOCUMENTS

| | | | | |
|---|---|---|---|---|
| 5,694,225 | A * | 12/1997 | Suzuki | 358/461 |
| 6,909,414 | B2 * | 6/2005 | Tsuchi et al. | 345/89 |
| 7,154,462 | B2 * | 12/2006 | Park et al. | 345/94 |
| 7,755,592 | B2 * | 7/2010 | Ham | 345/101 |
| 2002/0036625 | A1 * | 3/2002 | Nakamura | 345/204 |

* cited by examiner

*Primary Examiner* — Quan-Zhen Wang
*Assistant Examiner* — Calvin C Ma
(74) *Attorney, Agent, or Firm* — McKenna Long & Aldridge LLP

(57) ABSTRACT

A liquid crystal display (LCD) device and driving method for same is disclosed. The liquid crystal display device included: a plurality of pixel cells formed at pixel regions defined by crossings of a plurality of gate and data lines on a substrate, each pixel cell for displaying one of three colors, wherein the pixel cells are arranged with pixel cells of a single color arranged along the each gate line, and pixel cells of the three colors are alternately arranged along each data line; a gate built-in circuit built on the substrate that sequentially drives the gate lines; and a driving integrated circuit formed on the liquid crystal panel, that drives the gate built-in circuit and that modulates a video signal to be supplied to the data lines in response to an ambient temperature of the liquid crystal panel.

15 Claims, 8 Drawing Sheets

FIG. 5

| | | | | | |
|---|---|---|---|---|---|
| + | - | + | - | + | - |
| + | - | + | - | + | - |
| + | - | + | - | + | - |
| - | + | - | + | - | + |
| + | - | + | - | + | - |
| + | - | + | - | + | - |
| - | + | - | + | - | + |
| - | + | - | + | - | + |
| + | - | + | - | + | - |

FIG. 6

| | | | | | |
|---|---|---|---|---|---|
| + | - | + | - | + | - |
| + | - | + | - | + | - |
| + | - | + | - | + | - |
| - | + | - | + | - | + |
| - | + | - | + | - | + |
| - | + | - | + | - | + |
| + | - | + | - | + | - |
| + | - | + | - | + | - |
| + | - | + | - | + | - |

FIG. 7

| | | | | | |
|---|---|---|---|---|---|
| + | - | + | - | + | - |
| + | - | + | - | + | - |
| + | - | + | - | + | - |
| + | - | + | - | + | - |
| - | + | - | + | - | + |
| - | + | - | + | - | + |
| - | + | - | + | - | + |
| - | + | - | + | - | + |
| - | + | - | + | - | + |
| + | - | + | - | + | - |

LIQUID CRYSTAL DISPLAY DEVICE AND DRIVING METHOD THEREOF

This application claims the benefit of Korean Patent Application No. 10-2007-0013378 filed Feb. 8, 2007, which is hereby incorporated by reference for all purposes as if fully set forth herein.

BACKGROUND OF THE INVENTION

1. Field of the Invention

The present invention relates to a liquid crystal display (LCD) device, and more particularly, to an LCD device that can reduce a fabrication cost and can prevent a decrease in picture quality caused by unfilled pixel cells.

2. Discussion of the Related Art

A liquid crystal display (LCD) device controls an optical transmission ratio of liquid crystal molecules using an electric field to thereby display an image. In general, an LCD device is provided with a liquid crystal panel having liquid crystals between two glass substrates, a matrix of liquid crystal cells, with switching devices for respectively changing signals in the liquid crystal cells, a driving circuit for driving the liquid crystal panel, and a backlight unit for directing light onto the liquid crystal panel.

Recently there have been efforts to reduce the number of signal lines or the number of circuit components of the liquid crystal panel to develop a thin and light, as well as low cost liquid crystal display device. For example, Korean patent publication No. 10-2003-0039972 discloses a flexible printed circuit and a liquid crystal display device without a gate printed circuit board that can reduce the panel size and the production cost of the liquid crystal display device.

However, because a plurality of data and gate driver integrated circuits, data printed circuit boards, and the like are provided, the flexible printed circuit and the liquid crystal display device even without having a gate printed circuit board have problems in that the reduction of the size and the production cost is limited, and power consumption is high.

For the related art LCD device, if the ambient temperature of liquid crystal panel is low (for example, below −5° C.), the charging property of pixel cell is lowered so that it causes the deterioration of picture quality due to unfilled pixel cells.

SUMMARY OF THE INVENTION

Accordingly, the present invention is directed to a liquid crystal display (LCD) device and driving method thereof the same that substantially obviates one or more problems due to limitations and disadvantages of the related art.

An advantage of the present invention is to provide an LCD device that can reduce a fabrication cost and prevent lowering of picture quality caused by unfilled pixel cells, and driving method thereof.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these objects and other advantages and in accordance with the purpose of the invention, as embodied and broadly described herein, an LCD device includes: a liquid crystal display panel including a plurality of pixel cells formed at pixel regions on a substrate defined by crossings of a plurality of gate and data lines, each pixel cell for displaying one of three colors, wherein the pixel cells are arranged with pixel cells of a single color arranged along the each gate line, and pixel cells of the three colors alternately arranged along each data line; a gate built-in circuit on the substrate that sequentially drives the gate lines; and a driving integrated circuit formed on the liquid crystal panel that drives the gate built-in circuit, that receives video data and that generates modulated video data to drive the data lines in response to an indication of an ambient temperature of the liquid crystal panel lower than a predetermined temperature.

In another aspect of the present invention, a method for driving a liquid crystal display (LCD) device includes: receiving video data for display by the LCD device; generating a temperature detection signal that that indicates whether the ambient temperature of the LCD device is below a predetermined temperature; generating modulated video data in response the temperature detection signal indicating an ambient temperature below the predetermined temperature only during an inversion period in which a polarity of current video data for driving a data line is inverted from a polarity of previous video data for driving the data line; and driving data lines of the LCD device using the modulated video data.

In another aspect of the present invention, a driving integrated circuit for driving a liquid crystal display panel includes: a control signal generating unit that generates a temperature detection signal having a logic state that indicates whether the ambient temperature is below the predetermined temperature in response to the temperature signal indicating the ambient temperature; and a data modulating unit that receives video data and generates modulated video data in response to the temperature detection signal indicating an ambient temperature of the liquid crystal panel lower than a predetermined temperature and that outputs modulated data only when a polarity of current video data for driving a data line of the liquid crystal display panel is inverted from a polarity of previous video data for driving the data line.

In another aspect of the present invention, a modulating circuit for a liquid crystal display panel comprising: a gray scale modulating unit generates modulated video data and outputs the modulated video data only during an inversion period in which a polarity of current video data for driving a data line of the liquid crystal display panel is inverted from a polarity of previous video data for driving the data line; and a first selector that selects between outputting received video data to drive the data lines of the display and supplying data received video data to the gray scale modulating unit in response to a temperature detection signal indicating an ambient temperature below a predetermined temperature.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings:

FIG. 5 is a schematic diagram illustrating an LCD device according to the first embodiment of the present invention, and polarity patterns of video signals based on a driving method thereof;

FIG. 6 is a schematic diagram illustrating an LCD device according to the second embodiment of the present invention, and polarity patterns of video signals based on a driving method thereof;

FIG. 7 is a schematic diagram illustrating an LCD device according to the third embodiment of the present invention, and polarity patterns of video signals based on a driving method thereof;

DETAILED DESCRIPTION OF THE ILLUSTRATED EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 1:
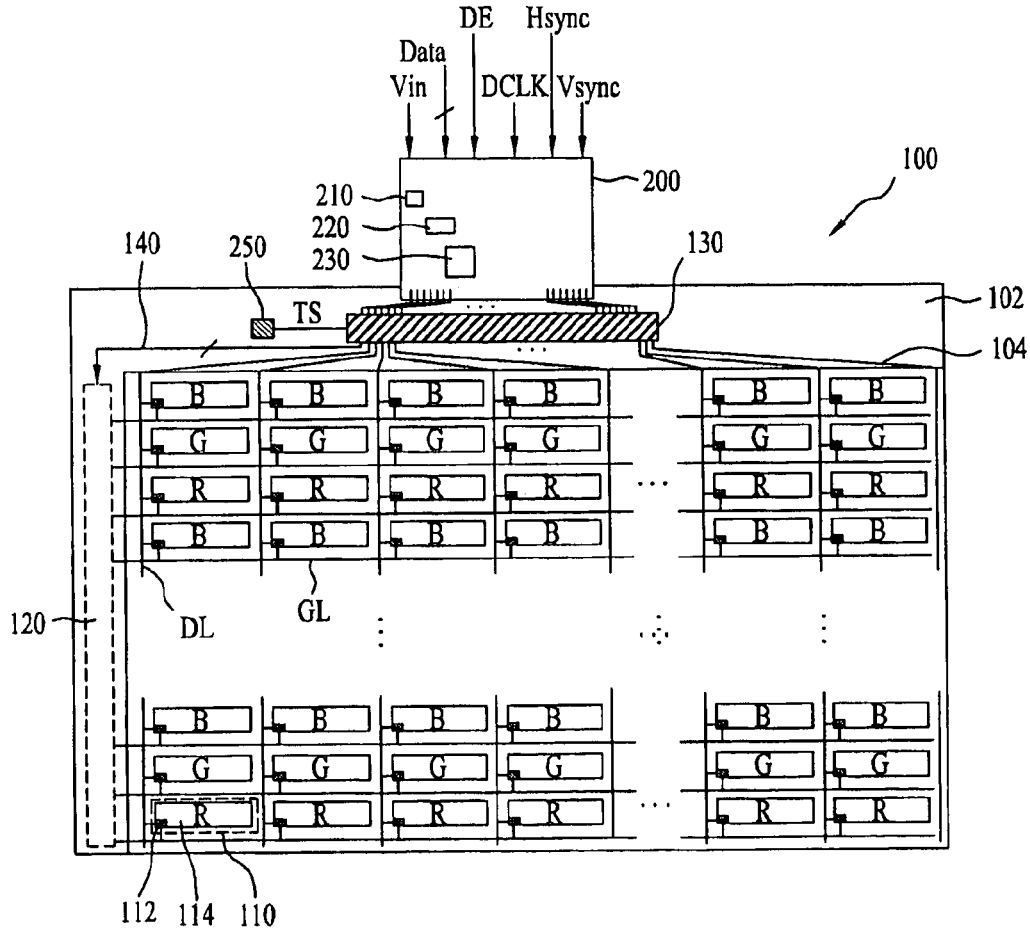
FIG. 1 is a schematic diagram illustrating a liquid crystal display (LCD) device according to first embodiment of the present invention.

FIG. 1 is a schematic diagram illustrating a liquid crystal display (LCD) device according to the first embodiment of the present invention. As shown in FIG. 1, the LCD device according to the first embodiment of the present invention includes a liquid crystal panel 100 having a plurality of pixel cells 10 defined by the crossing of a plurality of data lines DL and gate lines GL. In the illustrated example, the pixel cells 110 include three colors alternately arranged in BGR order along the data line direction (vertical direction), while pixels of the same color are arranged along the gate line direction (horizontal direction) near each gate line.

In addition, a gate built-in circuit 120 is built-in the liquid crystal panel 100 for driving the gate lines GL, and a driving integrated circuit 130 is formed in the liquid crystal panel 100 both for driving the gate built-in circuit 120 and for modulating video signals supplied to the data lines DL based on the ambient temperature in the vicinity of the liquid crystal panel 100. A flexible printed circuit 200 is attached to the liquid crystal panel 100 for connecting the liquid crystal panel 100 to an external driving system.

The liquid crystal panel 100 includes a lower substrate 102 and an upper substrate 104 facing each other and bonded together; spacers (not shown) for maintaining a constant cell gap between the lower and upper substrates 102 and 104; and a liquid crystal layer (not shown) filled in a liquid crystal space provided by the spacers.

The lower substrate 102 includes a display region that corresponds to the upper substrate 104 and a non-display region that excludes the display region. In the display region of the lower substrate 102, a plurality of data lines DL are formed at predetermined intervals parallel to each other along a first direction; a plurality of gate lines GL formed at predetermined intervals parallel to each other along a second direction; and the pixel cells 110 formed in the regions defined by the crossings of the plurality of data lines DL and gate lines GL. The first direction may be perpendicular to the second direction. The number of the data lines DL supplied with the video signal is smaller than the number of the gate lines GL supplied with gate-on voltages.

Each of the pixel cells 110 includes a thin film transistor 112 connected both to a gate line GL and a data line DL defining the pixel cell region; and a pixel electrode 114 connected to the thin film transistor 112. Each thin film transistor 112 includes a gate electrode connected to the gate line GL; a source electrode connected to the data line DL; and a drain electrode connected to the pixel electrode 114. As each thin film transistor 112 is switched-on in response to the gate-on voltage supplied to the gate line GL, each thin film transistor 112 supplies the video signal output from a data line DL to the corresponding pixel electrode 114.

The pixel electrode 114 has a short side parallel to the data line DL formed shorter than a long side parallel to the gate line GL. Accordingly, the pixel electrodes 114 may form horizontal stripes.

In the non-display region of the lower substrate 102, the gate built-in circuit 120 is connected to each of the plurality of the gate lines GL; and the driving integrated circuit 130 formed therein.

The upper substrate 104 includes color filters, a common electrode and a light shielding layer. The common electrode may be formed on the lower substrate 102 depending on the operating mode of the liquid crystals of the liquid crystal layer. The color filters include a red R color filter, a green G color filter, and a blue B color filter. The color filters are arranged so that red R, green G, and blue B color filters are alternately arranged along the data line DL direction, while color filters of the same color are arranged along the gate line GL direction at each gate line.

The common electrode may be formed over the entire upper substrate 104 or in shape of lines opposite to the pixel electrode 114 for forming a vertical electric field across the liquid crystal layer. Alternatively, the common electrode may be formed on the lower substrate 102 as electrodes parallel to the pixel electrodes 114 for forming a horizontal electric field across the liquid crystal layer.

The light shielding layer is formed on the upper substrate 104 to overlap regions of the pixel regions excluding aperture regions overlapping the pixel electrodes 114. Each of a red R, a green G, and a blue B pixel cells respectively on the red R color filter, the green G color filter, and the blue B color filter makes up a unit pixel for a color picture.

The flexible printed circuit 200 is provided in the non-display region of the lower substrate 102 and attached to a pad portion of the lower substrate 102. The flexible printed circuit 200 transmits a source data signal Data, and synchronizing signals DE, DCLK, Hsync, and Vsync from a driving system to the driving integrated circuit 130.

The driving integrated circuit 130 is formed in an integrated circuit forming portion having a plurality of input/output pads at the non-display region of the lower substrate 102. The driving integrated circuit 130 may include a plurality of input/output bumps to be electrically connected to the input/output pads at the integrated circuit forming portion, respectively.

In addition, the driving integrated circuit 130 generates a gate driving signal and a data control signal to divide one horizontal period corresponding to one period of the horizontal synchronizing signal Hsync into first to third sub-periods by using at least one of the synchronizing signals DE, DCLK, Hsync, and Vsync received from the flexible printed circuit 200.

The driving integrated circuit 130 aligns the source data signals Data in order of blue B, green G and red R data corresponding to the first to third sub-periods; modulates the aligned data based on the ambient temperature surrounding the liquid crystal panel 100; and converts the modulated data into video signals corresponding to analog signals; and supplies the video signals to the data lines DL. The polarity of the video signals is inverted in the unit of data line or at least two gate lines, and is also inverted in the unit of frame. That is, the polarity is inverted for each data line, for every two gate lines, and for every frame.

Figure 2:
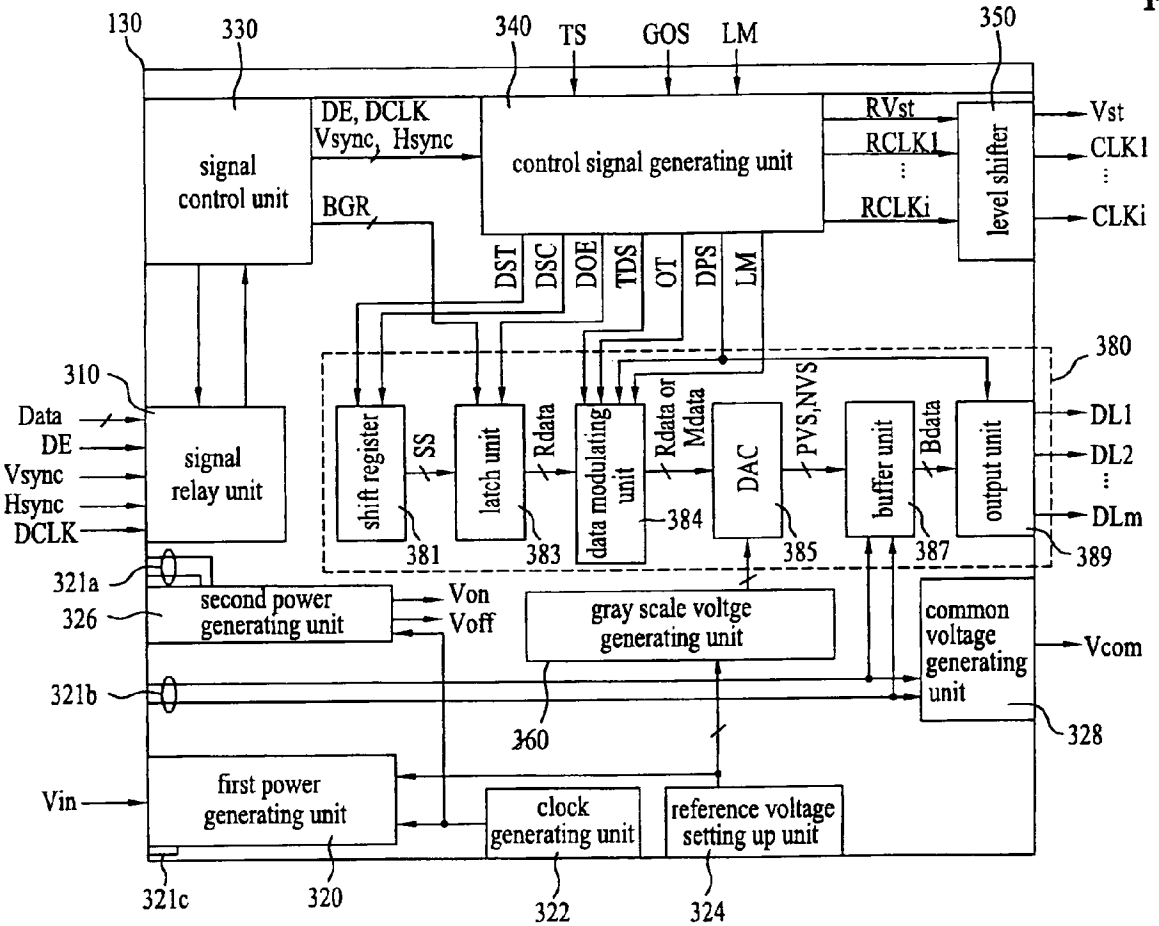
FIG. 2 is a block diagram illustrating a driving integrated circuit shown in FIG. 1.

For accomplishing the above described functions, as shown in FIG. 2, the driving integrated circuit 130 includes a signal relay unit 310, a first power generating unit 320, a clock generating unit 322, a reference voltage setting up unit 324, a second power generating unit 326, a common voltage generating unit 328, a signal control unit 330, a control signal generating unit 340, a level shifter 350, a gray scale voltage generating unit 360, and a data converting unit 380.

The signal relay unit 310 relays the source data signal Data and the synchronizing signals DE, DCLK, Hsync, and Vsync from the flexible printed circuit 200 to the signal control unit 330.

The clock generating unit 322 generates clock signals for driving the first and second power generating units 320 and 326.

The first power generating unit 320 generates a first power, i.e., first and second reference voltages VSP and VSN by using an input power Vin from the flexible printed circuit 200 and using the clock signal from the clock generating unit 322. In addition, passive elements, such as a resistor 210, capacitor 220 and inductor 230 in the flexible printed circuit 200 are connected to the first power generating unit 320 through power signal lines 321a, 32 1b, and 321c, and used for biasing the first and second reference voltages VSP and VSN generated at the first power generating unit 320 or setting up option functions of the driving integrated circuit 130.

The second power generating unit 326 generates a second power, i.e., first and second driving voltages Vdd and Vss, an integrated circuit driving voltage Vcc, a gate-on voltage Von and a gate-off voltage Voff, required for driving the liquid crystal panel 100 by using the first and second reference voltages VSP and VSN generated at the first power generating unit 320.

The reference voltage setting up unit 324 sets up levels of the first and second reference voltages VSP and VSN to be supplied to the gray scale voltage generating unit 360 from the first power generating unit 320. The common voltage generating unit 328 generates a common voltage Vcom to be supplied to the common electrode of the liquid crystal panel 100 by using the first and second driving voltages Vdd and Vss supplied to the passive elements on the flexible printed circuit 200 from the second power generating unit 326. The flexible printed circuit 200 includes a common voltage varying unit (not shown) for varying the common voltage Vcom generated at the common voltage generating unit 328 by using at least one of a resistor and capacitor.

The signal control unit 330 controls driving of the signal relay unit 310, and also controls the internal circuit block of driving integrated circuit 130.

The signal control unit 330 supplies the synchronizing signals DE, DCLK, Hsync, and Vsync from the signal relay unit 310 to the control signal generating unit 340.

The signal control unit 330 aligns the source data signal Data for one horizontal period from the signal relay unit 310 in an order of BGR. In other words, blue data B, green data G, and red data R are aligned in a sequence corresponding to the first to third sub-periods of a horizontal period. The signal control unit 330 supplies the blue data B aligned during the first sub-period of one horizontal period to the data converting unit 380; supplies the green data G aligned during the second sub-period of one horizontal period to the data converting unit 380; and supplies the red data R aligned during the third sub-period of one horizontal period to the data converting unit 380.

The control signal generating unit 340 generates data control signals DST, DSC, DOE, and DPS, and gate driving signals RVst, and RCLK1 to RCLKi by using at least one of the synchronizing signals DE, DCLK, Hsync, and Vsync from the signal control unit 330.

The data control signals DST, DSC, DOE, and DPS includes a data start signal DST, a data shift clock DSC, a data output signal DOE, and a data polarity signal DPS for controlling the data converting unit 380. The control signal generating unit 340 generates the data polarity signal DPS that inverts the polarity of the video signals in the unit of frame as well as in the unit of data line DL and at least two gate lines.

The gate driving signal RVst, and RCLK1 to RCLKi includes a gate start signal RVst and first to (i)th clock signals RCLK1 to RCLKi for driving the gate built-in circuit 120. The first to (i)th clock signals RCLK1 to RCLKi have phases delayed in sequence so that the first to (i)th clock signals RCLK1 to RCLKi are made to have pulse widths for turning on the thin film transistors in each of the sub-periods, respectively. The first to (i)th clock signals RCLK1 to RCLKi may have any one of two, four, six, eight, or ten phases depending on the design of the gate built-in circuit 120.

In addition, the control signal generating unit 340 supplies a temperature detection signal TDS corresponding to a temperature signal TS to the data converting unit 380, wherein the temperature signal TS is supplied from a temperature detection means 250 provided at one side of the liquid crystal panel 100. The temperature detection means 250 provided on the lower substrate 102 of the liquid crystal panel 100 generates the temperature signal TS corresponding to the ambient temperature of the liquid crystal panel 100. For example, if the temperature signal TS is generated corresponding to an ambient temperature above −5° C., the control signal generating unit 340 generates the temperature detection signal TDS having a first logic state. If the temperature signal TS corresponding to an ambient temperature below −5° C., the control signal generating unit 340 generates the temperature detection signal TDS having a second logic state.

The control signal generating unit 340 supplies a driving mode signal LM and a gray scale offset signal GOS set by a user to the data converting unit 380. The gray scale offset signal GOS corresponds to a control signal that sets adding and subtracting gray scale values to be added to and subtracted from the align data BGR to generate the modulation data if the ambient temperature is below −5° C. The driving mode signal LM of the liquid crystal panel 100 is in the first logic state when the liquid crystal panel 100 is a normally black driving mode, and is in the second logic state when the liquid crystal panel 100 is a normally white driving mode.

The level shifter 350 pulls up voltage levels of the gate driving signals RVst, and RCLK1 to RCLKi supplied from the control signal generating unit 340 by using the gate-on voltage Von and the gate-off voltage Voff supplied from the second power generating unit 326. The gate-on voltage Von is a voltage for turning on the thin film transistor 112 of each cell 110, and the gate-off voltage Voff is a voltage for turning off the thin film transistor 112 of each cell 110. The level shifter 350 supplies the gate driving signals Vst, and CLK1 to CLKi pulled up through a gate driving signal transmission line 140 at the non-display region of the lower substrate 102 to the gate built-in circuit 120.

The gray scale voltage generating unit 360 subdivides the first and second reference voltages VSP and VSN from the first power generating unit 320, to generate a plurality of gray scale voltages and supplies the plurality of gray scale voltages to the data converting unit 380. The plurality of gray scale voltages generates 2N positive (+) polarity gray scale voltages and 2N negative (−) polarity gray scale voltages, if the source data signal Data has N bits.

The data converting unit 380 includes a shift register 381, a latch unit 383, a data modulating unit 384, a digital-analog converting unit 385, a buffer unit 387, and an output unit 389.

The shift register 381 shifts the data start signal DST in sequence in response to the data shift clock DSC from the control signal generating unit 340, to generate a shift signal SS. The shift register 381 may be a bidirectional shift register that is driven in opposite directions in accordance with a directional signal from the signal control unit 330.

The latch unit 383 latches the aligned data BGR from the signal control unit 330 in sequence in response to the shift signal SS from the shift register 381. In addition, the latch unit 383 supplies the latched data Rdata to the data modulating unit 384 in response to the data output signal DOE from the control signal generating unit 340.

Figure 3:
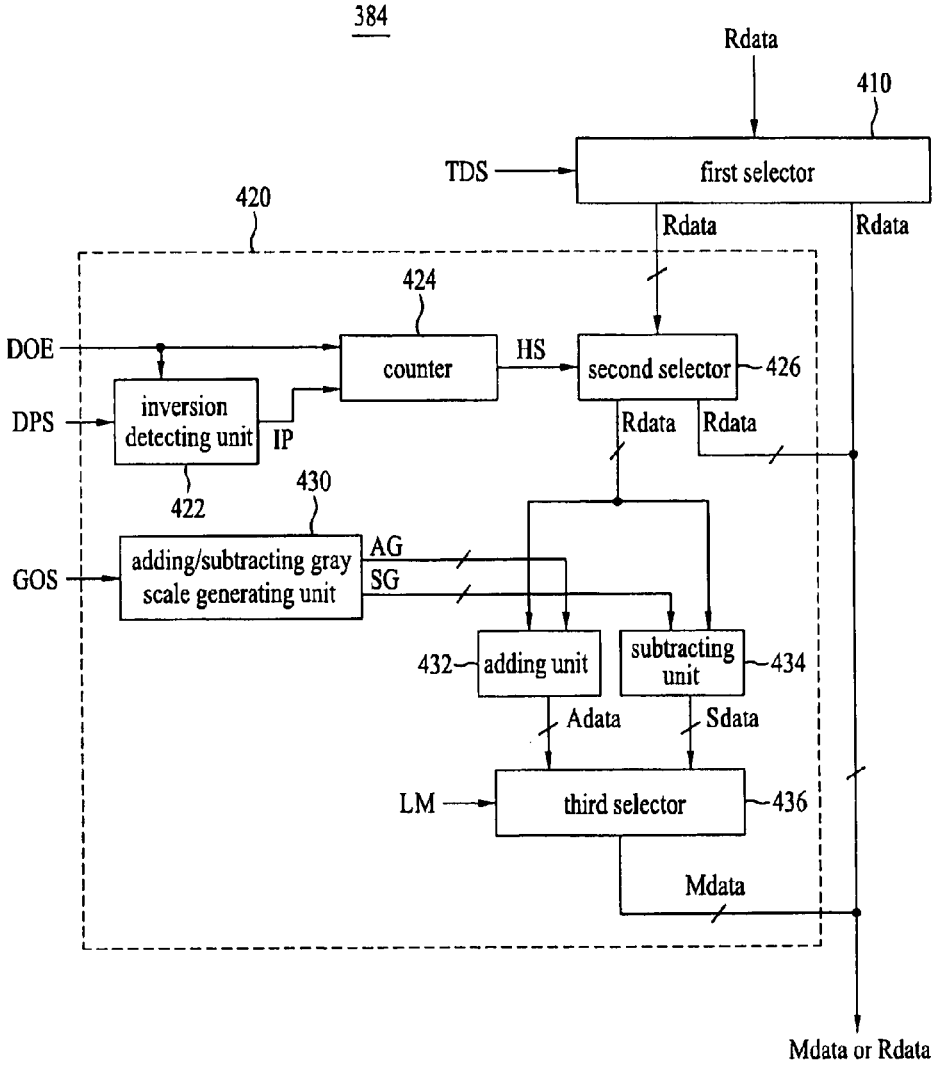
FIG. 3 is a block diagram illustrating a data modulating unit shown in FIG. 2.

As shown in FIG. 3, the data modulating unit 384 includes a first selector 410 and a gray scale modulating unit 420.

The first selector 410 selectively supplies the latched data Rdata from the latch unit 383 to the digital-analog converting unit 385 or the gray scale modulating unit 420 in response to the temperature detection signal TDS. That is, the first selector 410 supplies the latched data Rdata to the digital-analog converting unit 385 in response to the temperature detection signal TDS of the first logic state, or supplies the latched data Rdata to the gray scale modulating unit 420 in response to the temperature detection signal TDS of the second logic state.

The gray scale modulating unit 420 includes an inversion detecting unit 422, a counter 424, a second selector 426, an adding/subtracting gray scale generating unit 430, an adding unit 432, a subtracting unit 434 and a third selector 436.

The inversion detecting unit 422 detects an inversion period IP by using the data polarity signal DPS and data output signal DOE from the control signal generating unit 340. That is, the inversion detecting unit 422 detects the inversion period IP by detecting the number of data output signals DOE supplied during a high period (or low period) of the data polarity signal DPS. For example, if the data polarity signal DPS is inverted by the unit of two sub-periods, the inversion detecting unit 422 detects the inversion period IP as '2'. If the data polarity signal DPS is inverted by the unit of one horizontal period, the inversion detecting unit 422 detects the inversion period IP as '3'.

The counter 424 generates a horizontal detection signal HS corresponding to the inversion period IP supplied from the inversion detecting unit 422 by counting the data output signal DOE. That is, if the count of the data output signal DOE corresponds to the inversion period IP, the counter 424 generates the horizontal detection signal HS of the first logic state. If the count of the data output signal DOE does not correspond to the inversion period IP, the counter 424 generates the horizontal detection signal HS of the second logic state.

The second selector 426 supplies the latched data Rdata from the first selector 410 to the adding unit 432 and the subtracting unit 434 in response to the horizontal detection signal HS of the first logic state; and supplies the latched data Rdata to the digital-analog converting unit 385 in response to the horizontal detection signal HS of the second logic state.

The adding/subtracting gray scale generating unit 430 generates adding and subtracting gray scales AG and SG corresponding to the gray scale offset signal GOS from the control signal generating unit 340, supplies the adding gray scale AG to the adding unit 432, and supplies the subtracting gray scale SG to the subtracting unit 434. For example, the adding/subtracting gray scale generating unit 430 generates the adding and subtracting gray scale values AG and SG of '000001' in response to the gray scale offset signal GOS of '00'; and generates the adding and subtracting gray scale values AG and SG of '000010' in response to the gray scale offset signal GOS of '01'.

The adding unit 432 generates first modulation data Adata by adding the adding gray scale AG from the adding/subtracting gray scale generating unit 430 to the latched data Rdata from the second selector 426; and supplies the generated first modulation data Adata to the third selector 436.

The subtracting unit 434 generates second modulation data Sdata by subtracting the subtracting gray scale SG supplied from the adding/subtracting gray scale generating unit 430 from the latched data supplied from the second selector 426, and supplies the generated second modulation data Sdata to the third selector 436.

The third selector 436 selects the first modulation data Adata from the adding unit 432 as the modulation data Mdata in response to the driving mode signal LM of the first logic state; and supplies the first modulation data Adata to the digital-analog converting unit 385. The third selector 436 selects the second modulation data Sdata from the subtracting unit 434 as the modulation data Mdata in response to the driving mode signal LM of the second logic state; and supplies the second modulation data Sdata to the digital-analog converting unit 385.

The data modulating unit 384 supplies the latched data Rdata from the latch unit 383 to the digital-analog converting unit 385 in response to the temperature detection signal TDS of the first logic state supplied from the control signal generating unit 340. That is, the data modulating unit 384 supplies the latched data Rdata to the digital-analog converting unit 385 if the ambient temperature surrounding the liquid crystal panel 100 is above a predetermined low temperature such as −5° C.

The data modulating unit 384 modulates the latched data Rdata from the latch unit 383 in response to the horizontal detection signal HS of the first logic state and the temperature detection signal TDS of the second logic state supplied from the control signal generating unit 340; and supplies the modulated data to the digital-analog converting unit 385. The data modulating unit 384 adds the adding gray scale AG to the latched data Rdata, or subtracts the subtracting gray scale SG from the latched data Rdata in response to the driving mode of the liquid crystal panel 100, thereby generating the modulation data Mdata.

For example, if the ambient temperature of the liquid crystal panel 100 is below −5° C.; the driving mode of the liquid crystal panel 100 is the normally white driving mode; and the polarities of the video signals are inverted in the unit of two gate lines, the data modulating unit 384 generates the modulation data Mdata obtained by adding the subtracting gray scale SG from the latched data Rdata in the sub-period corresponding to the driving of the odd-numbered gate line; and supplies the latched data Rdata to the digital-analog converting unit 385 in the sub-period corresponding to the driving of the even-numbered gate line.

The digital-analog converting unit 385 converts the modulation data Mdata or latched data RData supplied from the gray scale modulating unit 384 into positive polarity and negative polarity video signals PVS and NVS by using the plurality of positive polarity gray scale voltages and negative polarity gray scale voltages from the gray scale voltage generating unit 360. The digital-analog converting unit 385 selects one gray scale voltage corresponding to a gray scale value of the latched data RData or modulation data Mdata from the plurality of positive polarity gray scale voltages as the positive polarity video signal PVS, and one gray scale voltage corresponding to a gray scale value of the latched data RData or modulation data Mdata from the plurality of negative polarity gray scale voltages as the negative polarity video signal NVS.

The buffer unit 387 buffers the positive polarity and negative polarity video signals PVS and NVS by using first and second driving voltages Vdd and Vss through the passive elements of the flexible printed circuit 200. For example, the buffer unit 387 amplifies the positive polarity and negative polarity video signals PVS and NVS to a level suitable for driving a load on the data lines DL.

The output unit 389 selects the positive polarity or the negative polarity video signal PVS or NVS supplied from the buffer unit 387 in response to the data polarity signal DPS from the control signal generating unit 340, and supplies the selected video signal to the data lines DL through respective output channels. That is, the polarity of the video signal selected and output by the output unit 389 for each data line depends on the logic state of the data polarity signal DPS.

Referring to FIG. 1, the gate built-in circuit 120 is formed at the non-display region of the lower substrate 102 concurrently with a process for forming the thin film transistors 112 and the gate built-in circuit 120 is connected to the plurality of gate lines GL. The gate built-in circuit 120 generates the gate-on voltage Von at every sub-period in response to pulled up gate driving signals Vst, and CLK1 to CLKi supplied from the driving integrated circuit 130, and supplies the gate-on voltage Von to the gate lines GL in sequence. For example, the driving integrated circuit 130 supplies the pulled up gate driving signals Vst, and CLK1 to CLKi to the gate built-in circuit 120 through the plurality of gate driving signal transmission lines 140 formed at the non-display region of the lower substrate 102.

Figure 4:
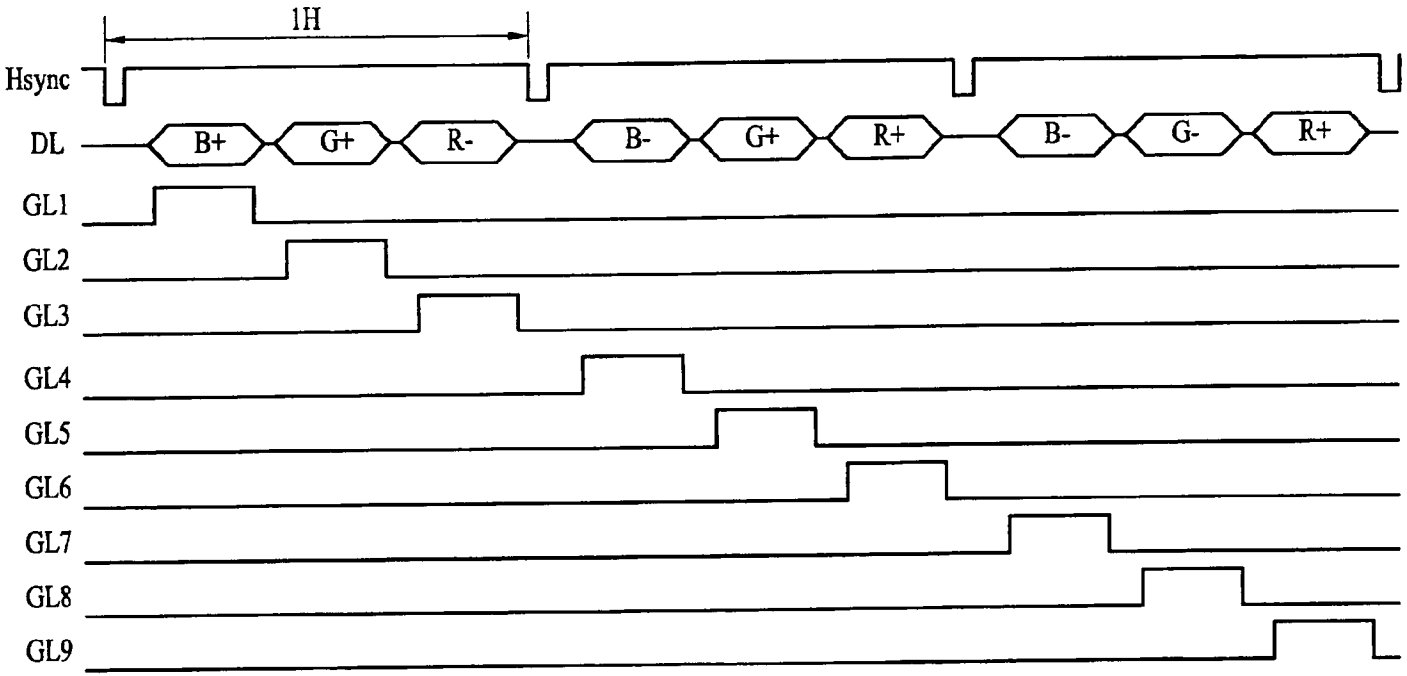
FIG. 4 is a waveform diagram illustrating a method for driving an LCD device according to the first embodiment of the present invention.

A method for driving an LCD device according to the first embodiment of the present invention will be explained with reference to FIG. 4 in association with FIGS. 1 to 3.

Supposing that the ambient temperature surrounding the liquid crystal panel 100 is about −10° C., the driving mode of the liquid crystal panel 100 is the normally white driving mode, and that the polarity of the video signal is inverted in the unit of two gate lines. Accordingly, the control signal generating unit 340 generates a temperature detection signal TDS of the second logic state and the driving mode signal LM of the first logic state.

During the first sub-period of the first horizontal period, and in synchronization with the supply of the gate-on voltage to the first gate line GL1, the modulated positive (+) polarity blue video signal B+ is supplied to the respective data lines DL. Thus, the pixel cells 110 of the first horizontal line display blue video corresponding to the modulated positive polarity blue video signal B+. The blue video signal B+ is the analog voltage corresponding to the modulation data Mdata obtained by subtracting the subtracting gray scale SG from the latched data Rdata in response to the driving mode signal LM of the first logic state and the horizontal detection signal HS of the first logic state. Accordingly, the charging time for the respective pixel cell 110 in the first horizontal line is made more rapid than would be obtained by applying the original video signal by using the modulated video signal.

During the second sub-period of the first horizontal period, and in synchronization with the supply of the gate-on voltage to the second gate line GL2, the positive (+) polarity green video signal G+ is supplied to the respective data lines DL. Thus, the pixel cells 110 of the second horizontal line display green video corresponding to the positive polarity green video signal G+. The green video signal G+ is the analog voltage corresponding to the latched data Rdata selected in response to the temperature detection signal TDS of the second logic state, the driving mode signal LM of the first logic state, and the horizontal detection signal HS of the second logic state.

During the third sub-period of the first horizontal period, and in synchronization with the supply of the gate-on voltage to the third gate line GL3, the modulated negative (−) polarity red video signal R− is supplied to the respective data lines DL. Thus, the pixel cells 110 of the third horizontal line display red video corresponding to the negative polarity red video signal R−. The red video signal R− is the analog voltage corresponding to the modulation data obtained by subtracting the subtracting gray scale SG from the latched data Rdata in response to the temperature detection signal TDS of the second logic state, the driving mode signal LM of the first logic state, and the horizontal detection signal HS of the first logic state. Accordingly, the charging time for the respective pixel cell 110 in the third horizontal line is made more rapid than the charging time for the original video signal by applying the modulated video signal.

As a result, during the first horizontal period, the blue, green and red videos are displayed at the sub-periods in sequence to temporally mix the blue, green and red videos to display the desired color video for each pixel of a first horizontal line of the display.

During the first sub-period of the second horizontal period, and in synchronization with the supply of the gate-on voltage to the fourth gate line GL4, the negative (−) polarity blue video signal B− is supplied to the respective data lines DL. Thus, the pixel cells 110 of the fourth horizontal line display blue video corresponding to the negative polarity blue video signal B−. The blue video signal B− is the analog voltage corresponding the latched data Rdata by the temperature detection signal TDS of the second logic state, the driving mode signal LM of the first logic state, and the horizontal detection signal HS of the second logic state.

During the second sub-period of the second horizontal period, and in synchronization with the supply of the gate-on voltage to the fifth gate line GL5, the positive (+) polarity green video signal G+ is supplied to the respective data lines DL. Thus, the pixel cells 110 of the fifth horizontal line display green video corresponding to the positive polarity green video signal G+. The green video signal G+ is the analog voltage corresponding to the modulation data Mdata obtained by subtracting the subtracting gray scale GS from the latched data Rdata in response to the temperature detection signal TDS of the second logic state, the driving mode signal LM of the first logic state, and the horizontal detection signal HS of the first logic state. Accordingly, the charging time for the respective pixel cell 110 in the fifth horizontal line is made more rapid than a response to the original video signal by using the modulated video signal.

During the third sub-period of the second horizontal period, and in synchronization with the supply of the gate-on voltage to the sixth gate line GL6, the positive (+) polarity red video signal R+ is supplied to the respective data lines DL. Thus, the pixel cells 110 of the sixth horizontal line display red video corresponding to the positive polarity red video signal R+. The red video signal R+ is the analog voltage corresponding to the latched data Rdata selected in response to the temperature detection signal TDS of the second logic state, the driving mode signal LM of the first logic state, and the horizontal detection signal HS of the second logic state.

As a result, during the second horizontal period divided into the first to third sub-periods, the blue, green and red videos are displayed at the sub-periods in sequence to temporally mix the blue, green and red videos to display the desired color video for each pixel in a second horizontal line of the display.

After the second horizontal period, the pixel cells of each horizontal period display color video according to the same method as those of the first and second horizontal periods. Accordingly, the polarity pattern of the video signal supplied to the liquid crystal panel 100 during one frame is inverted in the unit of frame, as well as in the unit of one data line and two gate lines, as shown in FIG. 5.

In the LCD device according to the first embodiment of the present invention, the liquid crystal panel is driven by one driving integrated circuit that is built in the liquid crystal panel, so that it is possible to reduce unit cost and to minimize the thickness of the LCD device. In addition, the polarity of the video signal may be inverted in the unit of data line and two gate lines, and the video signal supplied to the odd-numbered horizontal lines is modulated based on the ambient temperature in the environment of the liquid crystal panel 100, thereby preventing the deterioration of picture quality caused by the unfilled pixel cell on the inversion of the polarity of the video signal during operation in low-temperature environments.

FIG. 6 is a schematic diagram illustrating an LCD device according to the second embodiment of the present invention, and polarity patterns of video signals based on a driving method thereof.

Referring to FIG. 6, except for the polarity pattern of the video signal, the LCD device and its driving method according to the second embodiment of the present invention are identical to those according to the first embodiment of the present invention. Accordingly, a detailed understanding of the identical structural elements may be appreciated from the above description associated with FIGS. 1-4. In the LCD device and driving method of the second embodiment of the present invention, the polarity of video signal supplied to the liquid crystal panel 100 is inverted in the unit of frame as well as in the unit of data line and three gate lines.

In the LCD device according to the second embodiment of the present invention and the driving method thereof, if the ambient temperature of the liquid crystal panel 100 is below −5° C., the modulated video signal is supplied to the pixel cells of the (3j−2)th horizontal line (where 'j' is an integer) so as to make the charging time of the corresponding pixel cells more rapid, and the original video signal is supplied to the pixel cells of the other horizontal lines.

The LCD device according to the second embodiment of the present invention and its driving method can reduce the power consumption and obtain the same efficiency as that of the first embodiment of the present invention.

FIG. 7 is a schematic diagram illustrating an LCD device according to the third embodiment of the present invention, and polarity patterns of video signals based on a driving method thereof.

Referring to FIG. 7, except a polarity pattern of video signal, the LCD device and its driving method according to the third embodiment of the present invention is identical to those according to the first embodiment of the present invention. Accordingly, a detailed understanding of the identical structural elements may be appreciated from the above description associated with FIGS. 1-4. The polarity of video signal supplied to the liquid crystal panel 100 is inverted in the unit of frame as well as in the unit of one data line and four gate lines.

In the LCD device according to the third embodiment of the present invention and the driving method thereof, if the ambient temperature of the liquid crystal panel 100 is below −5° C., the modulated video signal is supplied to the pixel cells of the (4j−3)th horizontal line (where 'j' is an integer) so as to make the charging time of the corresponding pixel cells rapid, and the original video signal is supplied to the pixel cells of the other horizontal lines.

The LCD device according to the third embodiment of the present invention and its driving method can reduce the power consumption and obtain the same efficiency as that of the first embodiment of the present invention.

In the LCD devices according to embodiments of the present invention and their driving methods, the polarity of video signal is inverted in the unit of data line and at least two horizontal lines, and the video signal supplied to the pixel cells of each horizontal line having the different polarity from that of the preceding horizontal line is modulated so that it is possible to prevent the deterioration of picture quality caused by the unfilled pixel cell due to operation in a low-temperature environment.

Figure 8:
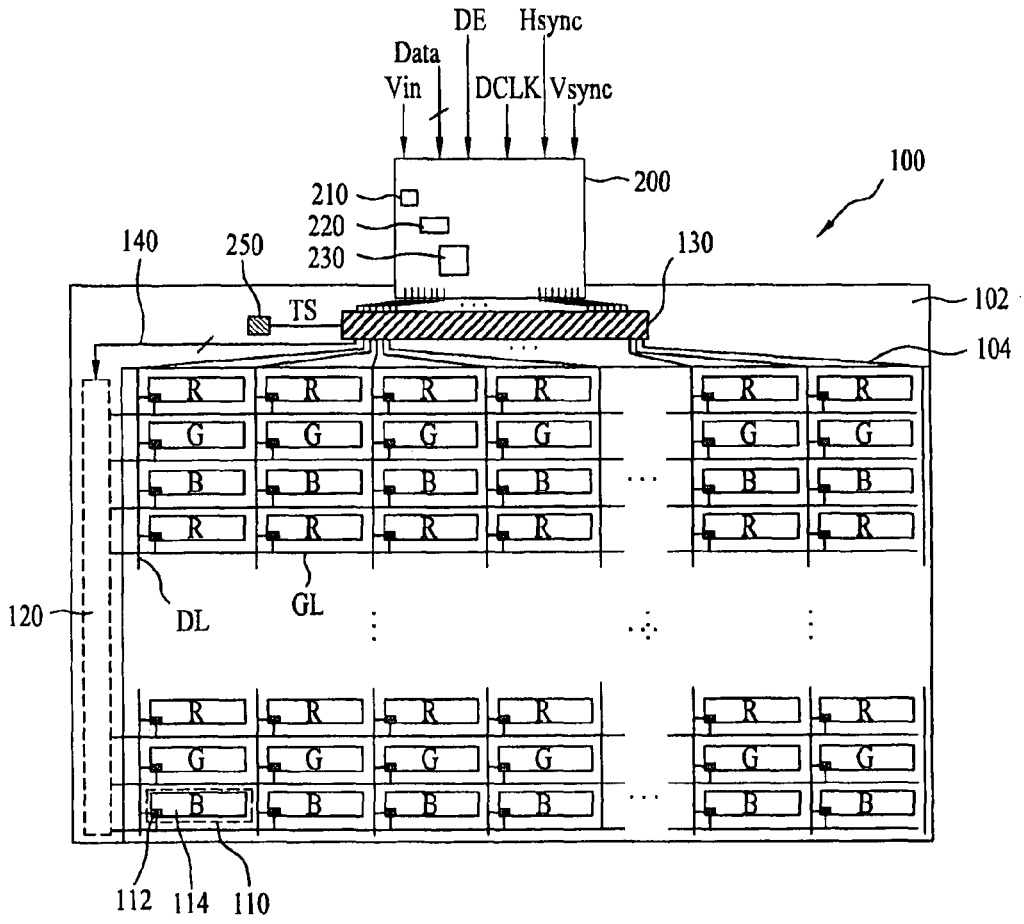
FIG. 8 is a schematic view illustrating an LCD device according to the fourth embodiment of the present invention.

FIG. 8 is a schematic view illustrating an LCD device according to the fourth embodiment of the present invention.

Referring to FIG. 8, the LCD device according to the fourth embodiment of the present invention is identical in structure to any one of the LCD devices according to the first to third embodiments of the present invention except that the arrangement of pixel cells 110 formed in the liquid crystal panel 100. Accordingly, a detailed explanation of the identical structural elements will be omitted.

The respective pixel cells 110 include the red R, green G, and blue B colors that are alternately and repetitively arranged in RGB order along the data line direction, with pixels of a single color arranged along the gate line direction near each gate line. Accordingly, the pixel electrodes 114 form horizontal stripes. A red R, green G, and blue B pixel cell 110 constitutes one unit pixel for displaying color video.

Figure 9:
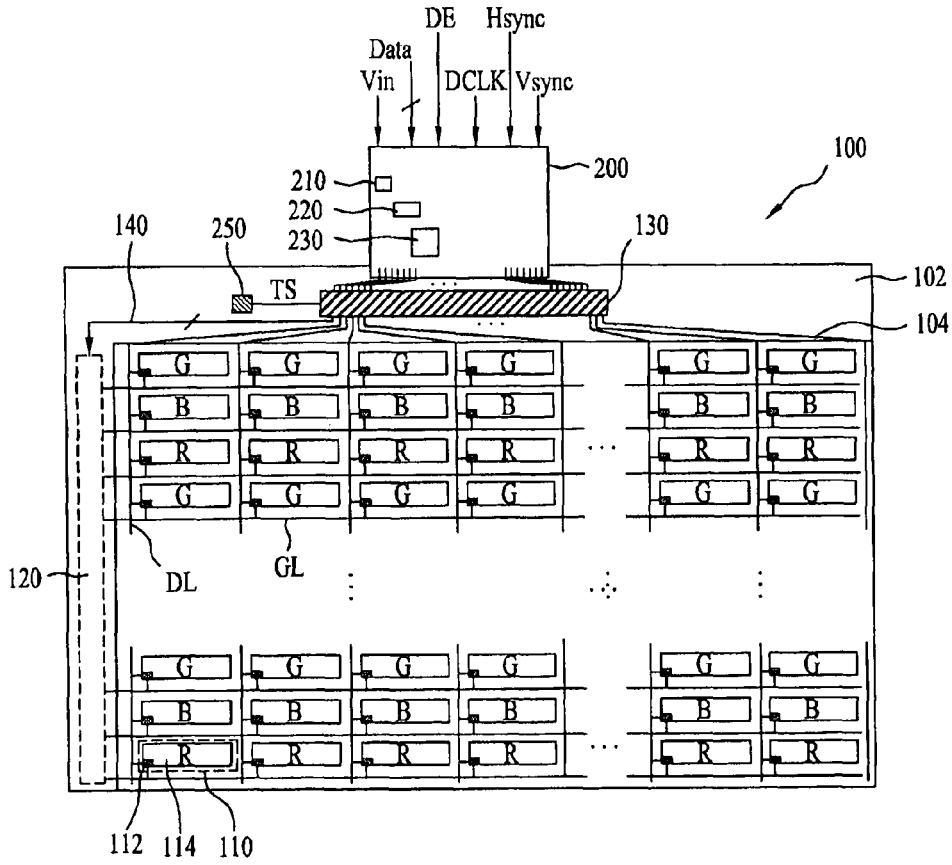
FIG. 9 is a schematic view illustrating an LCD device according to the fifth embodiment of the present invention.

FIG. 9 is a schematic view illustrating an LCD device according to the fifth embodiment of the present invention.

Referring to FIG. 9, the LCD device according to the fifth embodiment of the present invention is identical in structure to any one of the LCD devices according to the first to third embodiments of the present invention except the arrangement of pixel cells 110 formed in the liquid crystal panel 100. Accordingly, a detailed explanation of the identical structural elements will be omitted.

The respective pixel cells 110 include the green G, blue B, and red R colors that are alternately and repetitively arranged in GBR order along the data line direction, with pixels of a single color arranged along the gate line direction near each gate line. Accordingly, the pixel electrodes 114 form horizontal stripes. A green G, blue B, and red R cell 110 constitutes one unit pixel for displaying color video.

As mentioned above, the LCD device according to the present invention and the driving method thereof have the following advantages.

First, the liquid crystal panel is driven by one driving integrated circuit that is built in the liquid crystal panel, so that it is possible to reduce unit cost and to minimize the thickness of the LCD device.

In addition, the polarity of video signal is inverted in the unit of data line and at least two horizontal lines, and the video signal supplied to the pixel cells of each horizontal line having the different polarity from that of the preceding horizontal line is modulated so that it is possible to prevent the deterioration of picture quality caused by the unfilled pixel cell on the low-temperature driving.

The arrangement of the pixel cells of a single color along the horizontal direction permits a reduction in number of data lines by a third (⅓).

Accordingly as the liquid crystal panel is driven by one driving integrated circuit, the flexible printed circuit is minimized in size, allowing the unit cost of flexible printed circuit to be reduced.

As the gate driver to drive the gate lines is built into the liquid crystal panel, it is possible to eliminate a gate driver integrated circuit, a gate flexible printed circuit, and a gate printed circuit board.

Moreover, by manufacturing of the liquid crystal display device using a liquid crystal panel fabrication process, a driving integrated circuit mounting process, and a flexible printed circuit attachment process utilize a simplified manufacturing process to thereby minimizing a defect ratio.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display (LCD) device comprising:

a liquid crystal display panel including a plurality of pixel cells formed at pixel regions on a substrate defined by crossings of a plurality of gate lines and data lines, each pixel cell for displaying one of three colors, wherein the pixel cells are arranged with pixel cells of a single color arranged along each gate line, and pixel cells of the three colors alternately arranged along each data line;

a gate built-in circuit on the substrate that sequentially drives the gate lines; and a driving integrated circuit formed on the liquid crystal panel that drives the gate built-in circuit, that receives video data, and that generates modulated video data to drive the data lines in response to an indication that an ambient temperature of the liquid crystal panel is lower than a predetermined temperature, wherein the driving integrated circuit selects the modulated video data to drive the data lines in a first horizontal period, when a polarity of current video data is inverted from a polarity of video data of a previous horizontal period, and selects the video data to drive the data lines in a second horizontal period, when the polarity of current video data is the same as the polarity of video data of a previous horizontal period.

2. The LCD device according to claim 1, wherein the polarity of the video data supplied to a data line is inverted for every n gate lines, where n is an integer greater than or equal to 1, and wherein the driving integrated circuit supplies modulated data for a data line only during an inversion period in which the polarity of the data for the data line is inverted from immediately previous data supplied to the data line, in response to an indication that an ambient temperature of the liquid crystal panel is lower than a predetermined temperature.

3. The LCD device according to claim 1, wherein the polarity of the video data supplied to a data line is inverted for every 2 gate lines.

4. The LCD device according to claim 1 further comprising:

a low temperature sensor that generates a temperature signal corresponding to the ambient temperature of the liquid crystal panel, and wherein the driving integrated circuit generates a temperature detection signal having a logic state that indicates whether the ambient temperature is below the predetermined temperature in response to the temperature signal.

5. The LCD device according to claim 1, wherein the driving integrated circuit includes:

a gray scale modulating unit that generates modulated video data and outputs the modulated video data only during an inversion period in which a polarity of current video data for driving a data line of the liquid crystal display panel is inverted from a polarity of previous video data for driving the data line; and a first selector that selects between outputting received video data to drive the data lines of the display and supplying data received video data to the gray scale modulating unit in response to a temperature detection signal indicating that an ambient temperature is below a predetermined temperature.

6. The LCD device according to claim 5, wherein the driving integrated circuit further includes:

an inversion detecting unit that outputs an inversion period signal indicating an interval for inverting the polarity of received video data for driving a data line in response to a data polarity signal and a data output enable signal;

a counter that counts the data output enable signal and outputs a horizontal detection signal indicating an inversion period for a data line in response to the inversion period signal; and a second selector that selects between supplying the received video data to the data lines and modulating the received video data in response to the horizontal detection signal.

7. The LCD device according to claim 6, wherein the driving integrated circuit further includes:

an adding subtracting gray scale unit that outputs a gray scale offset value;

an adding unit that adds the gray scale offset value to the received video data to generate first modulated data;

a subtracting unit that subtracts the gray scale offset value from the received video data to generate second modulated data; and a third selector that selects between supplying first modulated data and supplying second modulated data to drive the data lines in response to the logic state of a drive mode signal, the drive mode signal having a first logic state when the liquid crystal display device operates in a normally black mode and a second logic state when the liquid crystal display device operates in a normally white mode.

8. A method for driving a liquid crystal display (LCD) device comprising:

receiving video data for display by a driving integrated circuit formed on the LCD device;

generating a temperature detection signal that indicates whether the ambient temperature of the LCD device is below a predetermined temperature;

modulating video data in response to the temperature detection signal indicating an ambient temperature below the predetermined temperature only during an inversion period in which a polarity of current video data for driving a data line is inverted from a polarity of previous video data for driving the data line;

selecting the modulated video data in a first horizontal period, when a polarity of current video data is inverted from a polarity of video data of a previous horizontal period, and selecting the video data to drive the data lines in a second horizontal period, when the polarity of current video data is the same as the polarity of video data of a previous horizontal period; and driving data lines of the LCD device using the selected video data.

9. The method for driving according to claim 8, wherein the liquid crystal display device includes a liquid crystal display panel having a plurality of pixel cells formed at pixel regions on a substrate defined by crossings of a plurality of gate lines and data lines, each pixel cell for displaying one of three colors, wherein the pixel cells are arranged with pixel cells of a single color arranged along each gate line, and pixel cells of the three colors alternately arranged along each data line.

10. The method according to claim 8, further comprising:

generating first modulator data by adding a gray scale value to the received video data;

generating second modulator data by subtracting a gray scale value from the received video data;

selecting one of the first modulator data and the second modulator data as the modulated video data in response to a driving mode signal indicating an operating mode of the LCD device.

11. The method according to claim 8, further comprising:

generating a driving mode signal having a first logic state in response to driving the LCD device in a normally black driving mode, and generating the driving mode signal having a second logic state in response to driving the LCD device in a normally white driving mode, wherein selecting one of the first modulate modulator data and the second modulator data as the modulated data includes selecting the first modulator data in response to the driving mode signal having the first logic state and selecting the second modulator data in response to the driving mode signal having the second logic state.

12. A driving integrated circuit for driving a liquid crystal display panel comprising:

a control signal generating unit that generates a temperature detection signal having a logic state that indicates whether the ambient temperature is below a predetermined temperature in response to the temperature signal indicating the ambient temperature; and a data modulating unit that receives video data and generates modulated video data in response to the temperature detection signal indicating an ambient temperature of the liquid crystal panel is lower than a predetermined temperature and that outputs modulated data only when a polarity of current video data for driving a data line of the liquid crystal display panel is inverted from a polarity of previous video data for driving the data line, wherein the data modulating unit selects the modulated video data to drive the data lines in a first horizontal period, when a polarity of current video data is inverted from a polarity of video data of a previous horizontal period, and selects the video data to drive the data lines in a second horizontal period, when the polarity of current video data is the same as the polarity of video data of a previous horizontal period.

13. A modulating circuit for a liquid crystal display panel comprising:

a gray scale modulating unit generating modulated video data and outputting the modulated video data only during an inversion period in which a polarity of current video data for driving a data line of the liquid crystal display panel is inverted from a polarity of previous video data for driving the data line; and a first selector receiving video data that selects between outputting the received video data to drive the data lines of the display and supplying the received video data to the gray scale modulating unit in response to a temperature detection signal, wherein the data modulating unit selects the modulated video data to drive the data lines in a first horizontal period, when a polarity of current video data is inverted from a polarity of video data of a previous horizontal period, while selects the video data to drive the data lines in a second horizontal period, when the polarity of current video data is the same as the polarity of video data of a previous horizontal period.

14. The modulating circuit according to claim 13, wherein the gray scale modulating unit includes:

an inversion detecting unit that outputs an inversion period signal indicating an interval for inverting the polarity of received video data for driving a data line in response to a data polarity signal and a data output enable signal;

a counter that that counts the data output enable signal and outputs a horizontal detection signal indicating an inversion period for a data line in response to the inversion period signal; and a second selector that selects between supplying the received video data to the data lines and modulating the received video data in response to the horizontal detection signal.

15. The modulating circuit according to claim 14, wherein the gray scale modulating unit further includes:

an adding subtracting gray scale unit that outputs a gray scale offset value;

an adding unit that adds the gray scale offset value to the received video data to generate first modulated data;

a subtracting unit that subtracts the gray scale offset value from the received video data to generate second modulated data; and a third selector that selects between supplying first modulated data and supplying second modulated data to drive the data lines in response to the logic state of a drive mode signal, the drive mode signal having a first logic state when the liquid crystal display device operates in a normally black mode and a second logic state when the liquid crystal display device operates in a normally white mode.

* * * * *